US007469649B2

(12) United States Patent
Watanabe

(10) Patent No.: US 7,469,649 B2
(45) Date of Patent: Dec. 30, 2008

(54) SEWING MACHINE

(75) Inventor: Hiroshi Watanabe, Kasugai (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 11/609,391

(22) Filed: Dec. 12, 2006

(65) Prior Publication Data

US 2007/0144417 A1 Jun. 28, 2007

(30) Foreign Application Priority Data

Dec. 14, 2005 (JP) ..... 2005-360336

(51) Int. Cl.
*D05B 51/00* (2006.01)

(52) U.S. Cl. ..... 112/278; 112/302

(58) Field of Classification Search ..... 112/57–59, 112/96, 97, 113, 241–243, 254, 255, 273, 112/278, 302; 700/136, 138, 143
See application file for complete search history.

(56) References Cited

U.S. PATENT DOCUMENTS 4,766,827 A * 8/1988 Matsubara ..... 112/278
5,322,029 A * 6/1994 Fujita ..... 112/278
5,339,758 A * 8/1994 Fujita ..... 112/278
5,842,432 A * 12/1998 Wakasugi ..... 112/278
6,012,405 A * 1/2000 Melton et al. ..... 112/278
6,092,478 A * 7/2000 Simakrai et al. ..... 112/278
6,163,733 A * 12/2000 Rubel ..... 700/130
6,317,644 B1 * 11/2001 Rubel ..... 112/273
7,225,747 B2 * 6/2007 Friman et al. ..... 112/254
7,240,628 B2 * 7/2007 Friman et al. ..... 112/475.01
2003/0140831 A1 * 7/2003 Zesch et al. ..... 112/475.01
2005/0199165 A1 * 9/2005 Friman et al. ..... 112/302
2005/0223958 A1 * 10/2005 Friman et al. ..... 112/302

FOREIGN PATENT DOCUMENTS

JP 2005-144056 A 6/2005

* cited by examiner

*Primary Examiner*—Gary L Welch
*Assistant Examiner*—Nathan E Durham
(74) *Attorney, Agent, or Firm*—Rossi, Kimms & McDowell, LLP

(57) ABSTRACT

Support section for contacting and movably supporting a string-shaped material is provided between a material holder and a guide member, and it supports the material, paid out from the holder, in a slackened condition while it applies a tensile force, corresponding to a state of the contact, to a portion of the material to be directed to the guide member. The consumed amount and the paid-out amount of the material can be controlled to agree with each other, which can prevent any excessive tensile force from being applied to the portion to be supplied to a sewing position and which can reduce the tensile force acting on the material and yet keep the tensile force generally constant. As a result, the string-shaped material can be sewn accurately in an aesthetically pleasing manner.

8 Claims, 5 Drawing Sheets

SEWING MACHINE

BACKGROUND OF THE INVENTION

The present invention relates generally to sewing machines of a type which sews an elongated string-shaped material, such as a tape or cord, onto a fabric (sewing workpiece) through lock stitching. More particularly, the present invention relates to an improved sewing machine in which a bobbin having an elongated string-shaped material wound thereon is disposed above a needle bar and has an increased size and which, in sewing the string-shaped material onto a sewing workpiece, allows the string-shaped material to be paid out smoothly from the bobbin by positively rotating the bobbin.

Heretofore, there have been known sewing machines of a type which includes a vertically driven needle bar, a sewing needle fixed to the lower end of the needle bar, a rotary member mounted concentrically with the needle bar and freely rotatable about the axis of the needle bar, and a guide fixed to the rotary member for guiding an elongated string-shaped material (i.e., string-shaped embroidering material, such as a tape or cord) to a sewing position of the sewing needle. The sewing machines of this type operate to sew the string-shaped material to a fabric, through lock stitching, while controlling the rotation of the rotary member in accordance with a moving direction of the fabric based on embroidery data and appropriately adjusting the orientation of the guide to optimize the direction in which the string-shaped material is guided to the sewing position of the sewing needle. One example of such sewing machines is known from Japanese Patent Application Laid-open Publication No. 2005-144056. The No. 2005-144056 publication discloses a sewing machine where, in order to permit an increased size of a bobbin (material holder) having a string-shaped material wound thereon, not only the bobbin is provided above the needle bar but also a drive means is provided for rotating the bobbin, on the basis of a tensile force acting on the string-shaped material, so that the string-shaped material can be supplied smoothly even where the bobbin has an increased size.

The sewing machine disclosed in the aforementioned No. 2005-144056 publication is briefed here. The bobbin, having the string-shaped material wound thereon, is mounted on a bobbin shaft that is supported at its opposite ends by a pair of opposed support members fixed to a machine frame, and the bobbin is supported at its opposite ends by a pair of holding members provided on the bobbin shaft. Pulley, which is driven to rotate by a drive motor provided on the support member, is provided in engagement with the lower end of one of opposed flanges of the bobbin. Thus, as the pulley is rotated by the drive motor, the bobbin is rotated. Beneath the bobbin, there are provided a first guide roller for winding therearound the string-shaped material paid out downward from the bobbin and inverting upward the wound string-shaped material, and a second guide roller for winding therearound the string-shaped material inverted by the first guide roller and re-inverting downward the string-shaped material. The first guide roller is rotatably mounted on a support arm fixed to the support member, while the second guide roller is rotatably mounted on a pivot arm pivotably fixed to the support member. Coil spring for normally urging the pivot arm upward is provided between the pivot arm and the support member. On a proximal end portion of the pivot arm, there are provided an actuating piece pivotable by the pivoting movement of the pivot arm, and a limit switch operable by the pivoting movement of the actuating piece. Driving by the drive motor is controlled in response to turning-on/off of the limit switch responsive to the pivoting movement of the actuating piece.

In sewing the string-shaped material, the string-shaped material, paid out from the bobbin, is sequentially wound around the first and second guide rollers and then directed to a machine head. As the string-shaped material is sewn onto a fabric in accordance with a progression of the sewing operation, the second guide roller is pulled by the string-shaped material to cause the pivot arm to pivot downward, so that the actuating piece pivots to turn on the limit switch. Once the limit switch is turned on in this way, the drive motor is activated, so that the bobbin is rotated to pay out the string-shaped material. When the tension of the string-shaped material has decreased due to the paying-out from the bobbin, the pivot arm is caused to pivot upward, upon which the actuating piece pivots in a direction opposite from the direction in which it pivoted at the time of the turning-on of the limit switch, so that the limit switch is turned off. Once the limit switch is turned off, the drive motor is deactivated, so that the rotation of the bobbin is stopped to stop the paying-out of the string-shaped material. Then, once the pivot arm is again caused to pivot downward as the sewing of the string-shaped material progresses, the bobbin is again rotated to pay out the string-shaped material. When the pivot arm has pivoted upward by the string-shaped material having been paid out from the bobbin by a sufficient amount, the rotation of the bobbin is stopped to stop the paying-out of the string-shaped material. Namely, during the sewing of the string-shaped material, the rotation and stoppage of the rotation of the bobbin is repeated, in accordance with a tensile force acting on the string-shaped material, to allow the string-shaped material to be paid out appropriately from the bobbin as the sewing operation progresses.

In the conventionally-known sewing machines like the one disclosed in the aforementioned No. 2005-144056 publication, as the string-shaped material wound on the bobbin is sewn onto the fabric, the pivot arm is caused to pivot downward by the second arm being pulled by the string-shaped material, so that the bobbin is driven to rotate to pay out the string-shaped material. Namely, in the sewing machines constructed to rotate the bobbin on the basis of a tensile force acting on the string-shaped material, there is provided a displacement member displaceable in accordance with the tension of the string-shaped material. Therefore, an excessive tensile force, commensurate with a load with which to displace the displacement member, would be applied to the string-shaped material. On the other hand, when the displacement member returns to the original position after the string-shaped material is paid out through rotation of the bobbin, the load is reduced. Therefore, in the sewing machines where the bobbin is rotated on the basis of the tension of the string-shaped material, an unnecessary, excessive tensile force would be applied to the string-shaped material when the string-shaped material is sewn onto the fabric, and, besides, such a tensile force would always vary. However, if the tensile force acting on the string-shaped material is not constant during the sewing of the string-shaped material, the sewing of the string-shaped material can not be performed accurately in an aesthetically pleasing manner. Thus, it has been extremely difficult for the conventionally-known sewing machines to manufacture products of uniform high quality which have a string-shaped material sewn in an aesthetically pleasing manner.

SUMMARY OF THE INVENTION

In view of the foregoing, it is an object of the present invention to provide an improved sewing machine which is of a type capable of smoothly paying out a string-shaped material from a bobbin by positively rotating the bobbin via a drive source, and which allows a tensile force, acting on the string-shaped material, to be always constant and can thereby manufacture products of uniform high quality which have a string-shaped material sewn appropriately in an aesthetically pleasing manner.

In order to accomplish the above-mentioned object, the present invention provides an improved sewing machine, which comprises: a needle bar vertically driven to perform a sewing operation; a sewing needle fixed to the lower end of the needle bar; a material holder holding a string-shaped material; a drive section for paying out the string-shaped material from the material holder; a guide member for guiding the string-shaped material, paid out from the material holder, to a sewing position of the sewing needle in accordance with a sewing-progressing direction, the string-shaped material being sewn onto a sewing workpiece through lock stitching in the sewing position; a consumed amount detection section for detecting a consumed amount of the string-shaped material that is consumed as sewing of the string-shaped material progresses; a support section provided, between the material holder and the guide member, for movably supporting the string-shaped material, paid out from the material holder, while contacting the material and keeping the material in a slackened condition, the support section applying a tensile force, corresponding to a state of the contact thereby of the string-shaped material, to a portion of the string-shaped material to be directed to the guide member; and a control section for controlling, in accordance with the consumed amount of the string-shaped material detected by the consumed amount detection section, an amount of paying-out, from the material holder, of the string-shaped material to be effected by the drive section.

According to the present invention, the support section for contacting and movably supporting the string-shaped material is provided between the material holder and the guide member. The string-shaped material, paid out from the material holder, is supported by the support section in a slackened condition, and a tensile force corresponding to a state of the contact, by the support section, of the string-shaped material is applied to a portion of the string-shaped material to be directed to the guide member. With the string-shaped material paid out from the material holder supported in a slackened state, control can be performed to prevent any tensile force from being applied from the bobbin to the portion of the string-shaped material to be directed to the guide member. Namely, by detecting an amount of the string-shaped material having been consumed as the sewing operation progresses (i.e., consumed amount of the string-shaped material) and controlling, in accordance with the thus-detected consumed amount of the string-shaped material, an amount of the string-shaped material to be paid out from the material holder through driving by the drive section (i.e., paid-out amount of the string-shaped material), the present invention can appropriately keep the string-shaped material, paid out from the material holder, in a slackened condition. As a consequence, the present invention can not only reduce a tensile force acting on the string-shaped material but also keep the tensile force generally constant.

Namely, in the present invention, the amount of the string-shaped material, having been consumed as the sewing of the string-shaped material progresses, is detected, and the string-shaped material is positively paid out from the material holder, in accordance with the thus-detected consumed amount, before the string-shaped material is pulled out from the material holder in interlocked relation to the sewing. The string-shaped material, paid out from the material holder, is directed, via the support member provided between the holder and the guide member, to the guide member with a portion of the material slackened. Namely, when the string-shaped material has been consumed as the sewing of the string-shaped material progresses, the string-shaped material is positively paid out from the material holder by an amount corresponding to the consumed amount before the slack is completely removed so that the tensile force acting on the string-shaped material starts increasing. In this way, the amount of the string-shaped material consumed as the sewing of the string-shaped material progresses and the amount of the material paid out from the material holder can be controlled to agree with each other, which can prevent any excessive tensile force (i.e., tensile force exceeding a minimum necessary tensile force for the sewing) from being applied to the string-shaped material when the material is paid out from the material holder in accordance with the consumption of the material. Such inventive arrangements can not only reduce the tensile force acting on the string-shaped material but also keep the tensile force generally constant. As a result, the present invention allows the string-shaped material to be sewn accurately in an aesthetically pleasing manner.

Therefore, according to the present invention, where the amount of the string-shaped material, having been consumed as the sewing of the string-shaped material progresses, is detected and the amount of the string-shaped material to be paid out from the material holder is controlled, in accordance with the detected consumed amount, so that the material paid out from the holder is allowed to always have an optimal slackened portion, it is possible to effectively reduce the tensile force acting on the string-shaped material and yet keep the tensile force generally constant. As a result, the present invention can manufacture products of uniform high quality which have the string-shaped material sewn appropriately in an aesthetically pleasing manner.

The above and other objects, features, and advantages of the invention will become more apparent from the following detailed description taken in conjunction with the accompanying drawings.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
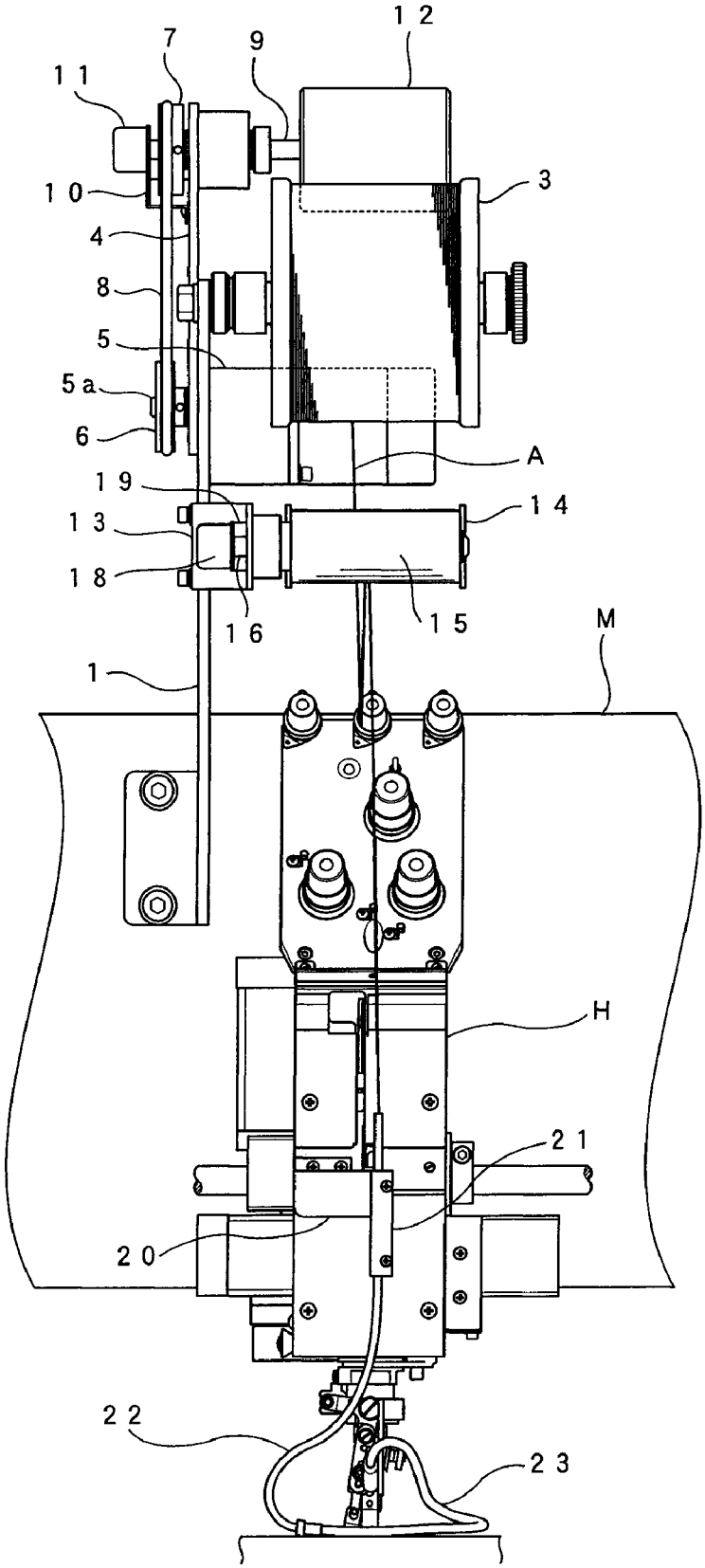
FIG. 1 is a front view showing an example external appearance of part of an embroidery sewing machine in accordance with an embodiment of the present invention.
Figure 2:
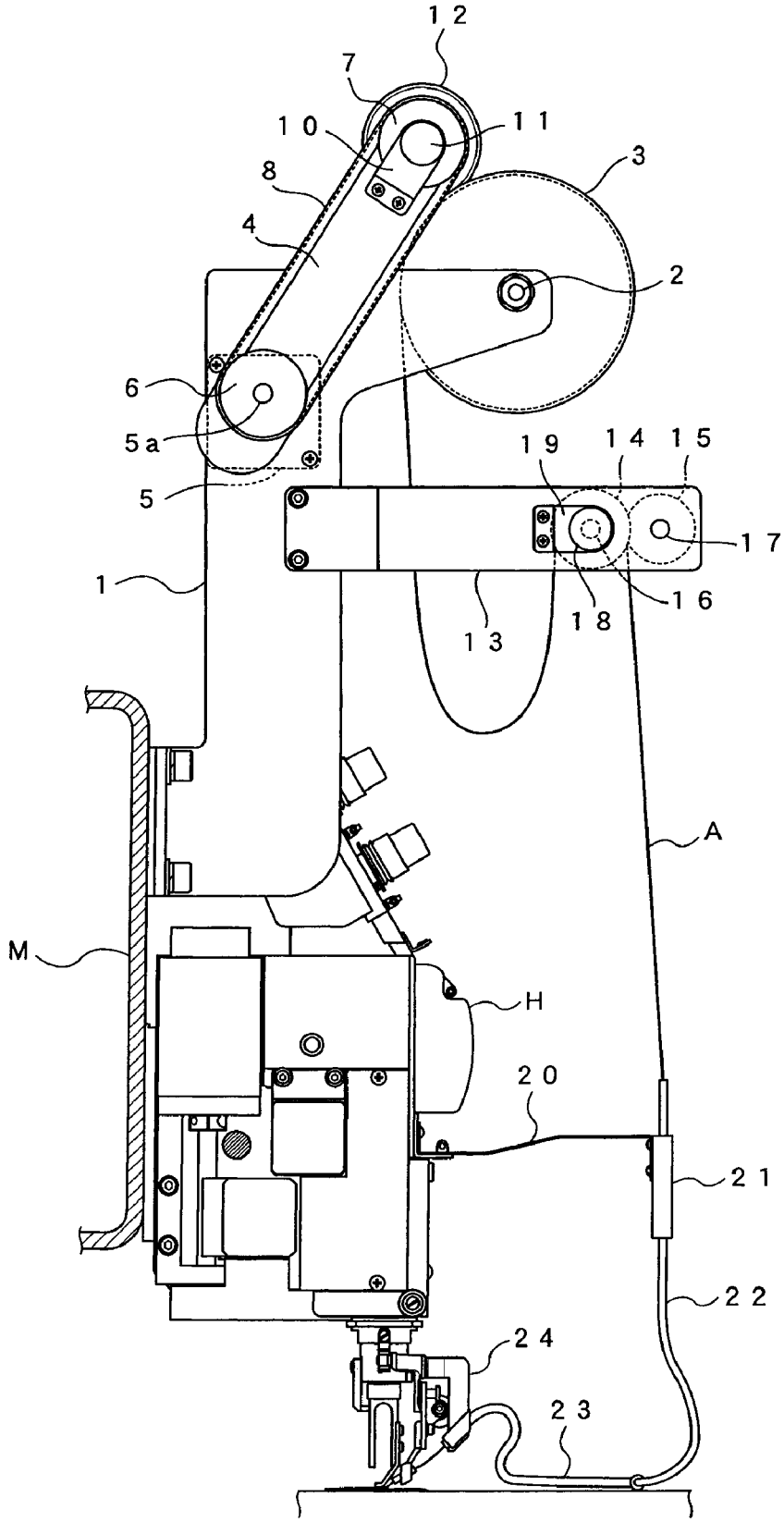
FIG. 2 is a left side view of the embroidery sewing machine as viewed from a left side of the machine shown in FIG. 1.
Figure 3:
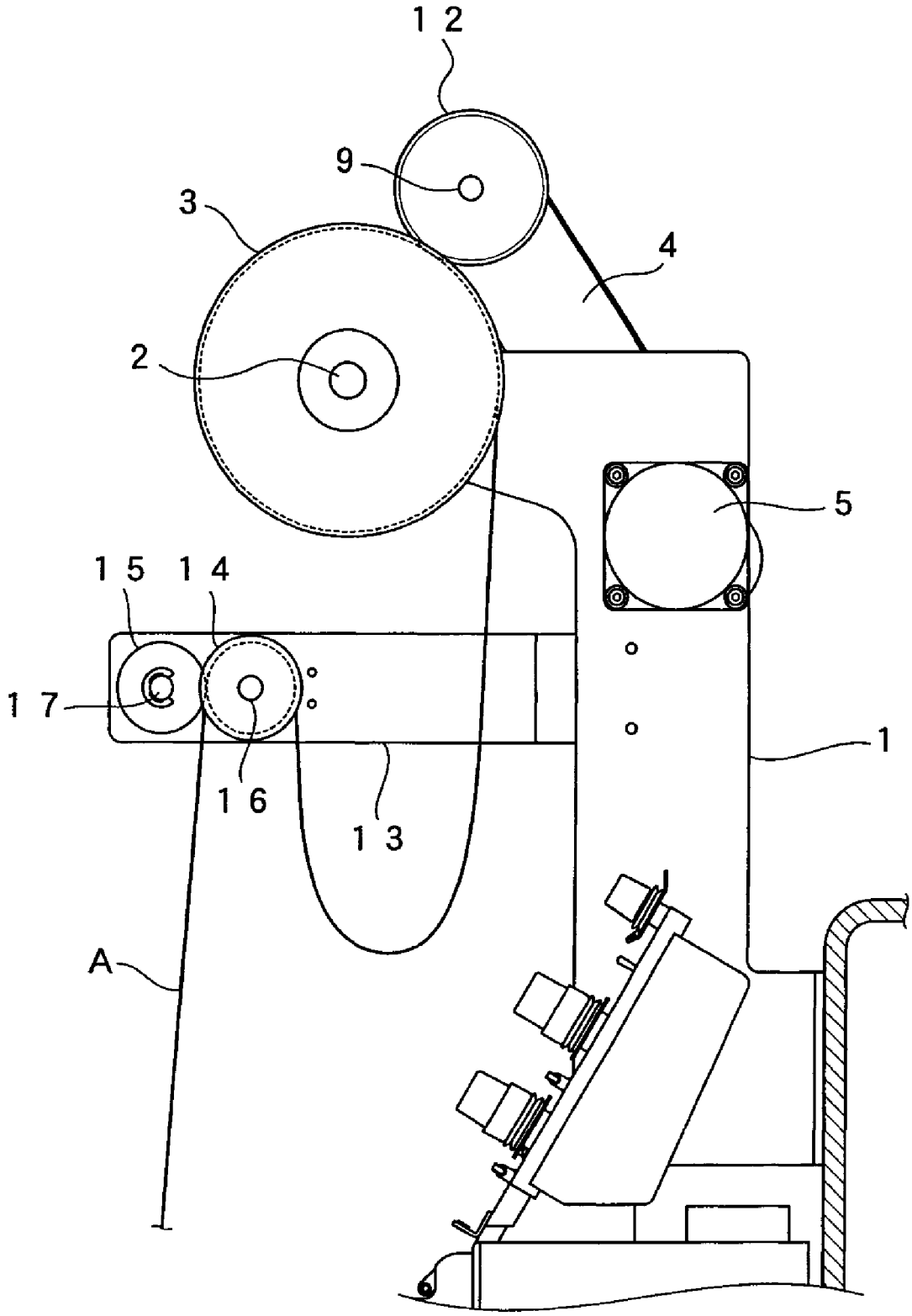
FIG. 3 is a partly-broken-away right side view of the embroidery sewing machine as viewed from a right side of the machine shown in FIG. 1.

FIG. 1 is a front view showing an example external appearance of part of an embroidery sewing machine in accordance with an embodiment of the present invention. FIG. 2 is a left side view of the embroidery sewing machine as viewed from the left side of the machine shown in FIG. 1. FIG. 3 is a partly-broken-away right side view of the embroidery sewing machine as viewed from the right side of the machine shown in FIG. 1. Whereas a plurality of machine heads H are disposed at predetermined intervals on the front surface (corresponding to a side of FIG. 1 closer to a reader of the figure, a right side in FIG. 2, or a left side in FIG. 3) of a machine frame M of the embroidery sewing machine, only one of the machine heads H is shown in the figures to facilitate understanding of the illustration and following description.

In addition to such machine heads H, a support member 1 is fixed, via bolts or the like, to a predetermined position (left-side position in FIG. 1) of the machine frame M. As seen from FIGS. 2 and 3, the support member 1, which is fixed to the front surface of the machine frame M, are formed into a shape having an arm section extending in a horizontal direction toward the front of the embroidery sewing machine (rightward in FIG. 2 or leftward in FIG. 3). Further, a bobbin shaft 2 is fixed to the distal end of the arm section. Bobbin (holder) 3 having a string-shaped material A, such as a tape or cord, wound thereon is detachably attached to the bobbin shaft 2. Any one of various bobbins 3 having different inner diameters can be attached to the bobbin shaft 2.

Support plate 4 is fixed to the support member 1 located on a left region of the machine frame M in FIG. 1, and the support plate 4 extends rightwardly and upwardly in FIG. 2 and has an upper end portion located above the bobbin 3. The support plate 4 has its proximal end portion rotatably supported, via a bearing (e.g., radial bearing), by a motor shaft 5*a* of a drive motor 5 that is fixed to the support member 1; thus, the support plate 4 is pivotable about the motor shaft 5*a*. Driving pulley 6 is fixedly mounted on the motor shaft 5*a*. Driven pulley 7 is rotatably mounted on a distal end portion of the support plate 4, and a round belt 8 is wound on and operatively connects between the driven pulley 7 and the driving pulley 6. The driven pulley 7 is fixed to one end of a rotation shaft 9 rotatably supported on a distal end portion of the support plate 4 in such a manner that it is rotatable together with the rotation shaft 9. First detector 11 for detecting a rotational angle of a feed pulley 12 is connected to one end of the rotation shaft 9, and a bracket 10 of the first detector 11 is fixed to the support plate 4 so that the first detector 11 can be prevented from rotating together with the rotation shaft 9.

The feed pulley 12 is fixedly mounted on the other end of the rotation shaft 9 in such a manner that it is rotatable together with the rotation shaft 9. Under the weights of the support plate 4, feed pulley 12, etc., the feed pulley 12 is held in abutment against the upper left surface (in FIG. 2) of the string-shaped material A wound on the bobbin 3. Thus, as the driving pulley 6 rotates by being driven by the drive motor 5, the rotation of the driving pulley 6 is transmitted, via the round belt 8, to the driven pulley 7, which rotates the feed pulley 12 fixed to the same rotation shaft 9 as the driven pulley 7. Namely, the rotational force produced from the drive motor 5 is sequentially transmitted to the driving pulley 6, round belt 8, driven pulley 7, shaft 9 and feed pulley 12 in the order mentioned, so that, ultimately, the bobbin 3 can be rotated by the thus-transmitted rotational force to pay out the string-shaped material A. In the aforementioned manner, the paid-out amount of the string-shaped material A from the bobbin 3 can be controlled in the instant embodiment.

Since the support plate 4 is pivotally supported on the support member 1, the support plate 4 is caused to pivot in a clockwise direction of FIG. 2 under the weights of the support plate 4, feed pulley 12, etc. as the amount of the string-shaped material A wound on the bobbin 3 decreases due to the paying-out of the string-shaped material A. In this way, the feed pulley 12 can be constantly kept in abutment against the string-shaped material A wound on the bobbin 3. Note that a biasing means (not shown) for normally biasing the support plate 4 in the clockwise direction of FIG. 2 may be provided on the support plate 4 so that the feed pulley 12 can be more reliably kept in abutment against the string-shaped material A wound on the bobbin 3. Also, a slip stopper member formed of, for example, rubber may be provided on the surface of the feed pulley 12 so as to prevent accidental slippage from occurring in the abutting engagement between the feed pulley 12 and the string-shaped material A wound on the bobbin 3 during the rotation of the feed pulley 12, so that the bobbin 3 can be rotated with an increased reliability to feed out the string-shaped material A more reliably.

Support arm 13 is secured to a substantial vertically-middle portion of the support member 1, and the support arm 13 extends horizontally toward the front of the embroidery sewing machine (rightward in FIG. 2, or leftward in FIG. 3). On predetermined distal end positions of the support arm 13, there are provided a first roller 14 for winding therearound the string-shaped material A, paid out downward from the bobbin 3, in such a manner that the string-shaped material A is first inverted upward and then again directed downward with a U-shaped slackened portion (in the illustrated example, U-shaped, hanging-down slackened portion) formed in the material A, and a second roller 15 for pressing the material A, wound around the first roller 14, against the first roller 14 so as to hold the material A between the rollers 14 and 15. Here, the first roller 14 is fixed to a shaft 16 rotatably supported by the support arm 13, and the second roller 15 is rotatably mounted on a pin 17 fixed to the support arm 13. The first and second rollers 14 and 15 together a support section for movably supporting the string-shaped material A and controlling a tensile force applied to the string-shaped material A. Namely, while no particular tensile force is positively applied to a portion of the string-shaped material A extending between the bobbin 3 and the first roller 14, a generally-constant tensile force controlled according to a frictional resistance in the support section is applied to another portion of the string-shaped material A hanging down from the first roller 14 to be directed to a guide 42 as will be later described.

Second detector 18 for detecting a rotational angle of the first roller 14 is connected to one end portion of the above-mentioned shaft 16, and a bracket 19 of the second detector 18 is fixed to the support arm 13 so as to prevent the second detector 18 from rotating together with the shaft 16. The string-shaped material A, paid out from the bobbin 3 as described above, is directed to between the two rollers 14 and 15, and a distance between the rollers 14 and 15 and intensity with which the rollers 14 and 15 press or hold the string-shaped material A therebetween are preset in such a manner that the rollers 14 and 15 can be rotated appropriately as the material A held therebetween moves in accordance with a progression of sewing of the material A. The first roller 14 has flanges formed on its opposite ends, and a distance between the opposed flanges of the first roller 14 is substantially equal to a width of the second roller 15. Thus, the string-shaped material A, pressed or held between the rollers 14 and 15, can be reliably prevented from coming away from any of the ends of the rollers 14 and 15. Alternatively, such flanges may be formed on the second roller 15 rather than on the first roller 14, or on one of the ends of the first roller 14 and one of the ends of the second roller 15 which is located opposite or remote from the one end of the first roller 14. Note that the pin 17, supporting the second roller 15, may be positionally-adjustably provided on the support arm 12 so that the distance or interval between the two rollers 14 and 15 can be adjusted in accordance with the thickness of the string-shaped material A.

Next, a description will be given about driving control performed on the drive motor 5 that rotates the bobbin 3. The second detector 18 (constituting a consumed amount detection section 52 shown in FIG. 5) comprises a rotation sensor that detects a rotational angle of the first roller 14 rotated in accordance with an amount of movement of the string-shaped material A corresponding to a progression of the sewing of the material A, and it calculates a consumed amount of the string-shaped material A (corresponding to an amount of the material A having been sewn onto the fabric) on the basis of the detected rotational angle. Once the calculated consumed amount of the string-shaped material A reaches a preset value or setting that may be a default value or a value set as desired by the user), the motor 5 is activated to rotate drive the bobbin 3. Of course, the feed roller 12 too rotates as the bobbin 3 is rotated by the motor 5. The first detector 11 detects a rotational angle of the feed roller 12. Paid-out amount, from the bobbin 3, of the string-shaped material A is calculated on the basis of the detected rotational angle of the feed roller 12. Once the thus-calculated paid-out amount of the string-shaped material A reaches the above-mentioned setting, the drive motor 5 is deactivated to stop the rotation of the bobbin 3. Namely, each time the string-shaped material A has been consumed by a given amount in accordance with a progression of the sewing, the bobbin 3 is rotated to pay out the material A. The rotation of the bobbin 3 is stopped when the material A has been paid out by an amount corresponding to the consumed amount.

Holder 21 is fixed, via a bracket 20, to the front surface (i.e., surface closer to the reader of FIG. 1, right side in FIG. 2 or left side in FIG. 3) of the machine head H located on the machine frame M beneath the support member 1, and a flexible first tube 22 for passing therethrough the string-shaped material A is fixed to the holder 21. Further, a second tube (e.g., spiral tube) 23, more flexible than the first tube 22, is connected to the distal end of the first tube 22. The second tube 23 is fixed at its distal end to a holder arm 24 that is in turn fixed to a later-described rotary bush 33 (see FIG. 4). The string-shaped material A, paid out from the bobbin 3, then wound around the first roller 14 with a slackened portion formed between the bobbin 3 and the roller 14, then pressed between the first and second rollers 14 and 15 and thence hanging down from between the rollers 14 and 15, can always be accurately directed, through the tubes 22 and 23 and via the guide 42 (to be later described), to a predetermined sewing position corresponding to the tip of a sewing needle 25.

Figure 4:
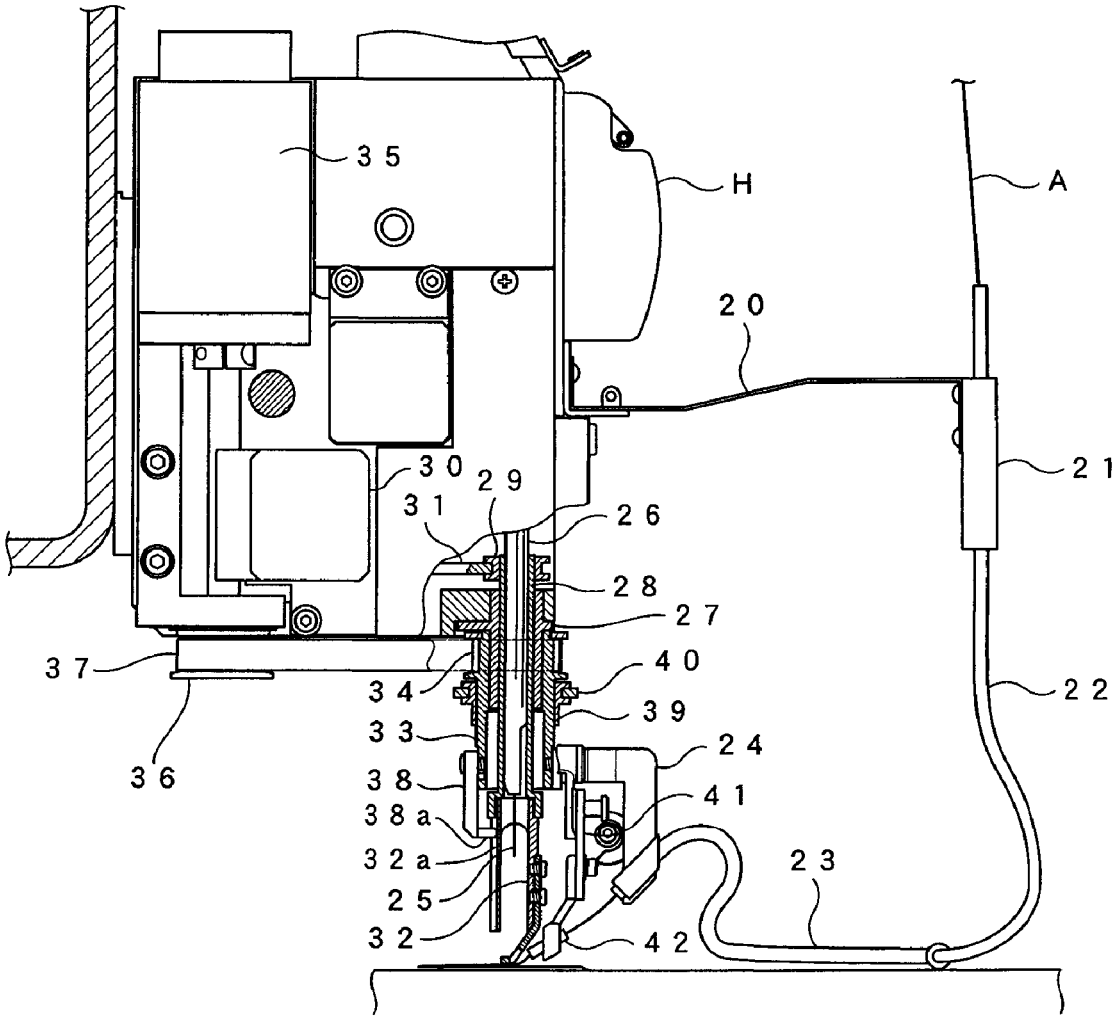
FIG. 4 is a partly-sectional side view of a machine head employed in the embodiment.

Now, details of the construction of the machine head H will be described with primary reference to FIG. 4. FIG. 4 is a partly-sectional side view of the machine head H. The machine head H employed here is of the conventional construction, where a needle bar 26 with the sewing needle 25 fixed to its lower end is vertically movably provided. Guide pipe 27 is fixed to a bottom plate of the machine head H, and a fabric-holder driving pipe 28 is provided within the guide pipe 27 in such a manner that it is vertically movable along and pivotable about the axis of the guide pipe 27. The needle bar 26 is passed through the interior of the fabric-holder driving pipe 28 for vertical movement therealong. Engaging ring 29 is fixed along the outer periphery of an upper end portion of the fabric-holder driving pipe 28, and a stroke arm 31, vertically movable via a motor 30, is held in engagement with the engaging ring 29. Fabric holder 32 is fixed to a lower end portion of the fabric-holder driving pipe 28. The rotary bush 33 is provided along the outer periphery of the guide pipe 27 in such a manner that it is rotatable about the axis of the needle bar 26. Timing pulley section 34 is formed on the outer periphery of an upper end portion of the rotary bush 33. The timing pulley section 34 is operatively connected, via a timing belt 37, with a driving pulley 36 that is rotatable via a motor 35. With such arrangements, the rotary bush 33 can be rotated by activation of the motor 35.

Engagement member 38 is fixed to the rotary bush 33 and extends downward therefrom, and the engagement member 38 has, at its distal end, an engagement section 38*a* engaged in a groove 32*a* formed vertically in the outer periphery of the fabric holder 32. Thus, the fabric holder 32 is vertically movable along and rotatable about the axis of the needle bar 26 together with the rotary bush 33. Interlocking member 39 is provided along the outer periphery of the rotary bush 33 in such a manner that it is vertically movable along and rotatable together with the rotary bush 33. Ring 44, vertically movable via a not-shown drive source, is provided in a groove formed in the outer periphery of the interlocking member 39. Further, a guide lever (e.g. zigzag swing lever) 41 is rotatably provided on the outer periphery of the rotary bush 33. The guide lever 41 is connected with the interlocking member 39 so as to pivot in response to (i.e., in interlocking relation to) the vertical movement of the interlocking member 39, and the pipe-shaped guide 42 for guiding the string-shaped material A to the sewing position of the sewing needle 25 is fixed to the lower end of the guide lever 41.

Figure 5:
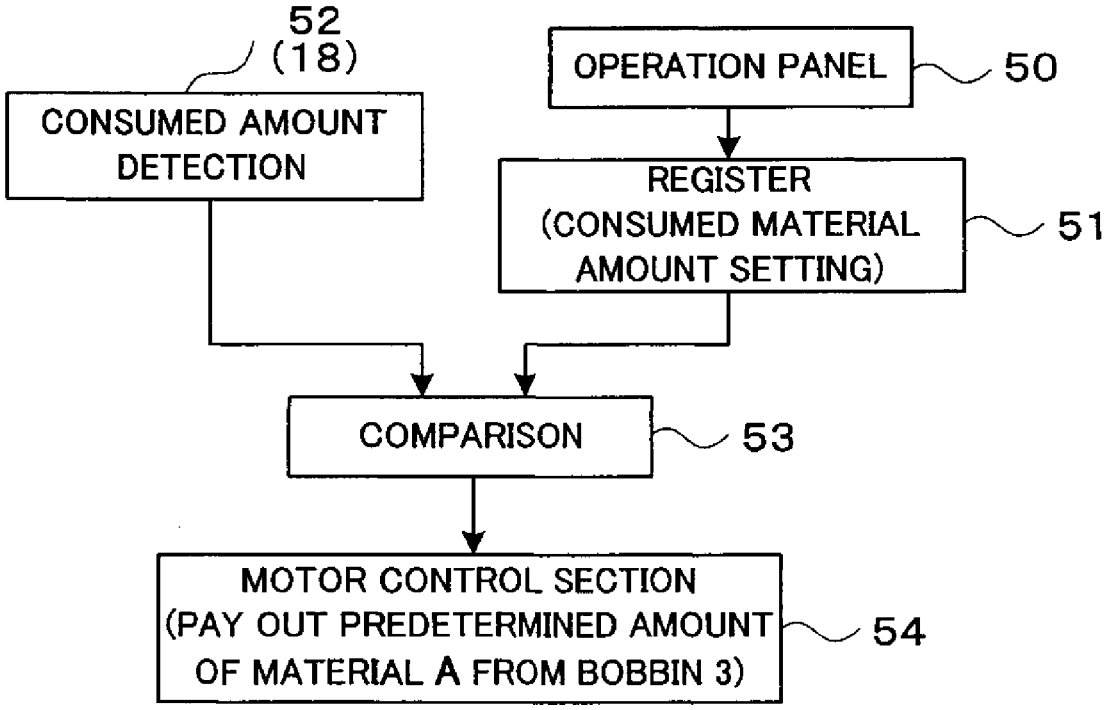
FIG. 5 is a block diagram showing an example of a control system employed in the embodiment.

Now, with reference to a control system block diagram of FIG. 5, a description will be given about a sewing operation performed by the embroidery sewing machine constructed in the above-described manner. The control system employed here is implemented by functions of a computer provided in the embroidery sewing machine. Using a setting means, such as an operation panel 50 of the conventional construction provided in the embroidery sewing machine, the human operator sets a value for setting a predetermined consumed amount of a string-shaped material A so that the bobbin 3 can be rotated to start paying out the string-shaped material A each time the predetermined consumed amount of the string-shaped material A has been consumed as the sewing operation progresses. The thus-set value (i.e., "consumed material amount setting") is stored into a register 51 within the computer provided in the embroidery sewing machine. Such a "consumed material amount setting" may be a predetermined default value rather than a desired value set by the human operator, in which case a desired one of a plurality of different default values may be selected automatically or manually in accordance with characteristics, such as the thickness, of the string-shaped material A. Then, the human operator causes the string-shaped material A to be paid out from the bobbin 3 and passed between the first and second rollers 14 and 15, with a sufficiently slackened portion formed between the bobbin 3 and the rollers, so that the slack remains in the string-shaped material A even when the material A has been consumed by the amount corresponding to the above-mentioned consumed material amount setting, i.e. in such a manner that the string-shaped material A is held wound around the first roller 14 without being tightly stretched between the bobbin 3 and the rollers 14, 15. After that, the human operator causes the string-shaped material A to be directed, by way of the first tube 22, second tube 23 and guide 42, to the sewing position of the sewing needle 25. After the string-shaped material A has been set in place in the aforementioned manner, an embroidery frame having a fabric (sewing workpiece) held therein is moved in the X and Y directions in a controlled manner on the basis of desired embroidery data, and the needle bar 26 is vertically driven to perform lock stitching in the conventionally-known manner through the functions of the sewing needle 25 and rotary hook (not shown). At that time, the fabric holder 32 is vertically driven by the motor 30 at predetermined timing relative to the vertical movement of the needle bar 26, as well known in the art. The ring 40 is vertically driven at predetermined timing relative to the vertical movement of the needle bar 26, so that the guide lever 41 is caused to pivot by vertical movement of the interlocking member 39. Thus, the string-shaped material A, having been directed to the sewing position of the sewing needle 26 via the guide 42 fixed to the lower end of the guide lever 41, is caused to swing to the left and right of the sewing position per reciprocative vertical movement of the needle bar 26 (i.e. per stitch). In this manner, the string-shaped material A is consumed by being sequentially sewn onto the fabric through so-called zigzag chain stitching.

The rotary bush 33 is driven to rotate by the motor 35 via the driving pulley 36, timing belt 37 and timing pulley 34, in response to which the guide 42 is controlled to be positioned forward in a relative moving direction of the machine head H. Namely, because the embroidery frame, having the fabric (sewing workpiece) held thereon, is moved in the X and Y directions in accordance with embroidery (sewing pattern) data, a direction in which a resultant vector of moved amounts in the X and Y coordinates of the embroidery frame is oriented becomes the sewing-progressing direction, and the motor 35 is rotated through an appropriate angle in the forward or reverse direction, in accordance with the embroidery date, so that the string-shaped material A is oriented in the sewing-progressing direction. In this way, the string-shaped material A can be appropriately guided to the sewing position of the sewing needle 25. Note that, if the rotary bush 33 is rotated through 360° or over, there is a possibility of the second tube 23 getting entwined around the machine head H; thus, it is necessary to create the embroidery data in such a manner as to prevent the rotary bush 23 from being rotated through 360° or over.

As the string-shaped material A is sewn onto the fabric in the aforementioned manner, the slack of a portion of the material A, hanging down in a U shape between the bobbin 3 and the first roller 14, gradually decreases (i.e., the hanging-down amount of the material A gradually decreases). In the control system shown in FIG. 5, a consumed amount detection section 52 calculates or detects a consumed amount of the material A (corresponding to an amount of the material A having been sewn onto the fabric) on the basis of a detection output of the second detector 18. Comparison section 53 compares the detected consumed amount of the string-shaped material A and the above-mentioned consumed material amount setting. Once the detected consumed amount reaches the consumed material amount setting, the bobbin 3 is rotated, by the motor 5 being activated by a motor control section 54, so that the string-shaped material A is paid out from the bobbin 3 by a predetermined amount; thus, the amount of the slack (i.e., hanging-down amount) of the string-shaped material A between the bobbin 3 and the first roller 14 is increased as compared to that prior to the paying-out of the material A. Thus, between the bobbin 3 and the first roller 14, the string-shaped material A can extend always with a given slack, without the slack being completely removed, even during the sewing operation (see FIG. 1). Needless to say, in the instant embodiment, the string-shaped material A is consumed successively during the sewing of the material A, and thus, each time the consumed amount of the string-shaped material A, calculated by detecting an amount of the material A, fed by the first roller 14, has reached the consumed amount setting, the consumed amount detection section 52 clears the preceding detection result and resumes the consumed amount detecting calculation.

According to the above-described embroidery sewing machine, the string-shaped material A is passed between the two rollers 14 and 15 in a slackened condition, and the second detector 18 detects rolling of the first roller 14 caused by the passage of the string-shaped material A, in order to detect the consumed amount of the material A. In order to allow the first roller 14 to roll reliably, it is necessary that the second roller 15 has be somewhat pressed against the first roller 14, in which case a tensile force would act on a portion of the string-shaped material A located downstream of the first roller 14 (i.e., portion located between the first roller 14 and the guide 42). However, because the string-shaped material A is always slackened in its portion located upstream of the first roller 14 (i.e., portion located between the bobbin 3 and the first roller 14), the upstream portion of the string-shaped material A is subjected to no tensile force even during the sewing of the material A, which can thereby reduce the tensile force acting on the downstream portion of the material A as the material A is consumed. Further, the tensile force can be kept substantially constant although small, because tensile force control is performed, in the instant embodiment to constantly keep slackened the portion of the string-shaped material A having been paid out from the bobbin 3.

Namely, according to the instant embodiment of the present invention, where the string-shaped material A is paid out from the bobbin 3 while being adjusted so as to always have a slack in accordance with the consumed amount of the string-shaped material A. Thus, a substantially constant tensile force can always be applied to the string-shaped material A with no excessive load applied to the material A. As a result, the instant embodiment can manufacture high-quality products where the string-shaped material A has been sewn accurately and beautifully or in an aesthetically pleasing manner, and these products can have uniform high quality.

The driving by the drive motor 5 may be controlled in such a manner that a difference between the detected values of the first and second detectors 11 and 18 falls within a predetermined range, i.e. that the slack of the string-shaped material A between the bobbin 3 and the first roller 14 falls within a predetermined range.

Although the above-described embodiment is arranged to drive the bobbin 3 to rotate by the feed pulley 12 contacting the string-shaped material A wound on the bobbin 3, the present invention is not so limited. For example, the bobbin 3 may be driven to rotate by a roller rolling on the outer periphery of any of the flanges of the bobbin 3, in which case there is no need for the support plate 4 to be rotatably supported. However, in this case, the first detector 11 has to be arranged to detect the paid-out amount, from the bobbin 3, of the string-shaped material A.

The drive motor 5 may be a pulse motor that is driven in accordance with the consumed amount of the string-shaped material A, in which case the first detector 11 can be dispensed with. Further, in this case, the pulse motor may be driven in real time on the basis of the detection result of the second detector 18. In this way, the slack of the string-shaped material A can be made always constant. Further, the pulse motor may be mounted at the upper end of the support plate 4 to directly drive the feed pulley 12.

Whereas the preferred embodiment has been described above in relation to the case where the string-shaped material A is sewn onto the fabric or sewing workpiece by the so-called chain stitching, the present invention is of course not so limited.

Further, the preferred embodiment has been described above as using, as the consumed amount detection section 52, the second detector 18 for detecting rotation of the first roller 14 rotated in accordance with the consumed amount of the string-shaped material A. Alternatively, the consumed amount detection section 52 may comprise a calculation means for indirectly detecting (estimating) a consumed amount of the string-shaped material A on the basis of the embroidery data. For example, a resultant vector in one stitch of the string-shaped material A may be determined to detect (estimate) magnitude of the vector as a consumed amount of the string-shaped material A. Adding up the consumed amounts of the string-shaped material A detected (estimated) for individual stitches can detect (estimate) a cumulative consumed amount of the material A. Further, the support section for movably supporting the string-shaped material A between the bobbin 3 located above the machine head H and the guide 42 located beneath the machine head H may be of any desired construction, without being limited to the above-described construction including the first and second rollers 14 and 15, as long as it can keep generally constant the tensile force acting on the string-shaped material A to be directed to the lower guide 42. For example, the support section may comprise only the first roller 14 and a cover or guide piece that may be provided in any suitable position for preventing the material A from coming off the support section, in which case the second roller 15 is dispensed with.

What is claimed is:

1. A sewing machine comprising:

a needle bar vertically driven to perform a sewing operation;

a sewing needle fixed to a lower end of said needle bar;

a material holder holding a string-shaped material;

a drive section that directly applies a rotational force to the material holder in order to pay out the string-shaped material;

a guide member for guiding the string-shaped material, paid out from said material holder, to a sewing position of said sewing needle in accordance with a sewing-progressing direction, the string-shaped material being sewn onto a sewing workpiece through lock stitching in the sewing position;

a consumed amount detection section for detecting a consumed amount of the string-shaped material that is consumed as sewing of the string-shaped material progresses;

a support section, provided between said material holder and said guide member, for movably supporting the string-shaped material, paid out from said material holder while contacting the material, wherein said support section supports the string-shaped material in a slackened condition at a first location to prevent tensile force from being applied to the material holder, and applies a constant tensile force to the string-shaped material at a second location prior to the string-shaped material being directed to said guide member; and a control section that controls, in accordance with the consumed amount of the string-shaped material detected by said consumed amount detection section, an amount of paying-out of the string-shaped material from said material holder, to be effected by said drive section.

2. A sewing machine as claimed in claim 1 wherein said support section comprises a pair of rollers that hold the string-shaped material, wherein the pair of rollers is located between the material holder and the guide member.

3. A sewing machine as claimed in claim 2 wherein a distance between the pair of rollers is adjustable in accordance with a thickness of the string-shaped material.

4. A sewing machine as claimed in claim 2 wherein at least one of the pair of rollers has flanges formed thereon for preventing the string-shaped material from coming away from between the rollers.

5. A sewing machine as claimed in claim 2, wherein the first location is located between the material holder and the pair of rollers and the second location is located between the pair of rollers and the guide member.

6. A sewing machine as claimed in claim 1 wherein said consumed amount detection section includes a sensor for detecting an actual paid-out amount, from said material holder, of the string-shaped material.

7. A sewing machine as claimed in claim 1 wherein said consumed amount detection section performs an arithmetic operation for estimating the consumed amount of the string-shaped material based on embroidery data.

8. A sewing machine as claimed in claim 1, therein the support section supports said string-shaped material at the first location in the form of a U-shape slackened portion.

* * * * *